US010727585B2

(12) United States Patent
Lee et al.

(10) Patent No.: US 10,727,585 B2
(45) Date of Patent: Jul. 28, 2020

(54) DIRECTIONAL MONOPOLE ARRAY ANTENNA USING HYBRID TYPE GROUND PLANE

(71) Applicant: Hongik University Industry-Academia Cooperation Foundation, Seoul (KR)

(72) Inventors: Jeong-Hae Lee, Seoul (KR); Jae-Gon Lee, Gwangmyeong-si (KR)

(73) Assignee: Hongik University Industry-Academia Cooperation Foundation, Seoul (KR)

( * ) Notice: Subject to any disclaimer, the term of this patent is extended or adjusted under 35 U.S.C. 154(b) by 452 days.

(21) Appl. No.: 15/658,369

(22) Filed: Jul. 24, 2017

(65) Prior Publication Data

US 2019/0020108 A1 Jan. 17, 2019

(30) Foreign Application Priority Data

Jul. 11, 2017 (KR) ..... 10-2017-0087772

(51) Int. Cl.

| | |
|---|---|
| ***H01Q 3/26*** | (2006.01) |
| ***H01Q 21/06*** | (2006.01) |
| ***H01Q 3/34*** | (2006.01) |
| ***H01Q 15/14*** | (2006.01) |
| ***H01Q 9/32*** | (2006.01) |
| ***H01Q 1/48*** | (2006.01) |
| ***H01Q 15/00*** | (2006.01) |
| ***H01Q 21/08*** | (2006.01) |
| *H01Q 1/36* | (2006.01) |

(52) U.S. Cl.

CPC ..... *H01Q 3/2676* (2013.01); *H01Q 1/48* (2013.01); *H01Q 3/34* (2013.01); *H01Q 9/32* (2013.01); *H01Q 15/006* (2013.01); *H01Q 15/008* (2013.01); *H01Q 15/148* (2013.01); *H01Q 21/061* (2013.01); *H01Q 21/08* (2013.01); *H01Q 1/36* (2013.01)

(58) Field of Classification Search

CPC .. H01Q 19/10; H01Q 15/0013; H01Q 15/006; H01Q 3/2676; H01Q 3/2376

See application file for complete search history.

(56) References Cited

U.S. PATENT DOCUMENTS

| | | | | |
|---|---|---|---|---|
| 7,034,761 | B2 | 4/2006 | Chiang et al. | |
| 8,018,375 | B1 * | 9/2011 | Alexopoulos | H01Q 19/10 342/175 |
| 8,188,928 | B2 * | 5/2012 | Lin | H01Q 9/0407 343/700 MS |
| 9,281,564 | B2 | 3/2016 | Vincent | |

(Continued)

FOREIGN PATENT DOCUMENTS

| | | |
|---|---|---|
| EP | 1 324 423 A1 | 7/2003 |
| KR | 10-2004-0006157 A | 1/2004 |

(Continued)

*Primary Examiner* — Dameon E Levi
*Assistant Examiner* — Jennifer F Hu
(74) *Attorney, Agent, or Firm* — Revolution IP, PLLC

(57) ABSTRACT

Provided is a directional monopole array antenna using a hybrid ground plane in which a plurality of monopole antennas are connected in a form of an array, wherein the monopole antennas includes: a ground plane designed to be divided into a PMC (perfect magnetic conductor) and a PEC (perfect electric conductor) such that a surface current induced in the PEC flows in a direction; and an antenna device vertically disposed in the ground plane.

6 Claims, 11 Drawing Sheets

(56) References Cited

U.S. PATENT DOCUMENTS

| | | | | |
|---|---|---|---|---|
| 2005/0195124 | A1* | 9/2005 | Puente Baliarda | H01Q 9/0414 343/893 |
| 2008/0316134 | A1* | 12/2008 | Sato | H01Q 1/245 343/787 |
| 2009/0295662 | A1* | 12/2009 | Suetsuna | H01Q 1/48 343/787 |
| 2010/0201584 | A1* | 8/2010 | Schaffner | H01Q 1/3275 343/713 |
| 2011/0057851 | A1* | 3/2011 | Chung | H01Q 1/48 343/793 |
| 2014/0049437 | A1* | 2/2014 | Hung | H01Q 21/28 343/841 |
| 2015/0029062 | A1* | 1/2015 | Ng | H01Q 15/24 343/713 |
| 2015/0130673 | A1* | 5/2015 | Ng | G06F 30/39 343/713 |

FOREIGN PATENT DOCUMENTS

| | | | |
|---|---|---|---|
| KR | 10-2008-0038061 | A | 5/2008 |
| KR | 10-2010-0059076 | A | 6/2010 |

* cited by examiner

【FIG. 7】
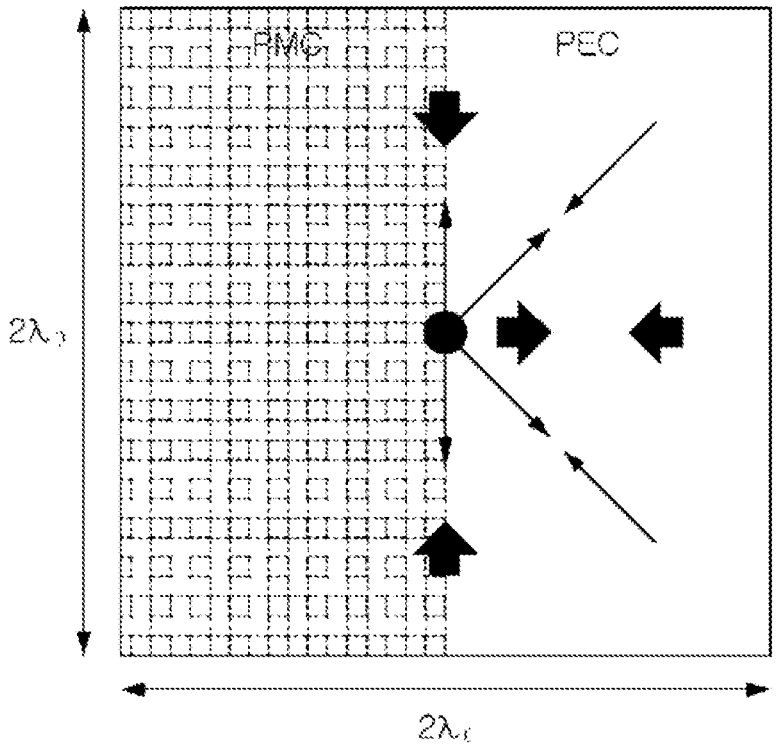
【FIG. 8】
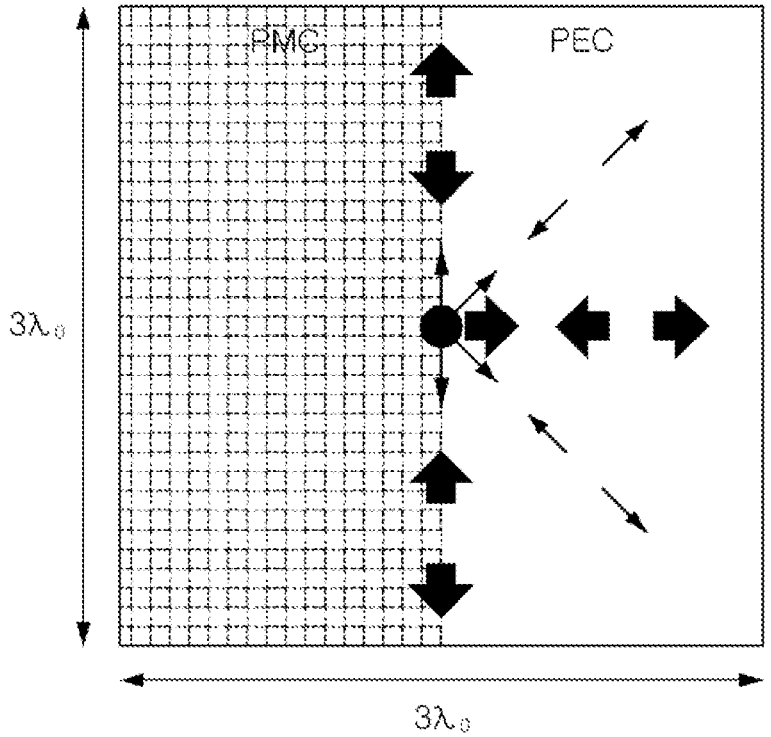

【FIG. 9】
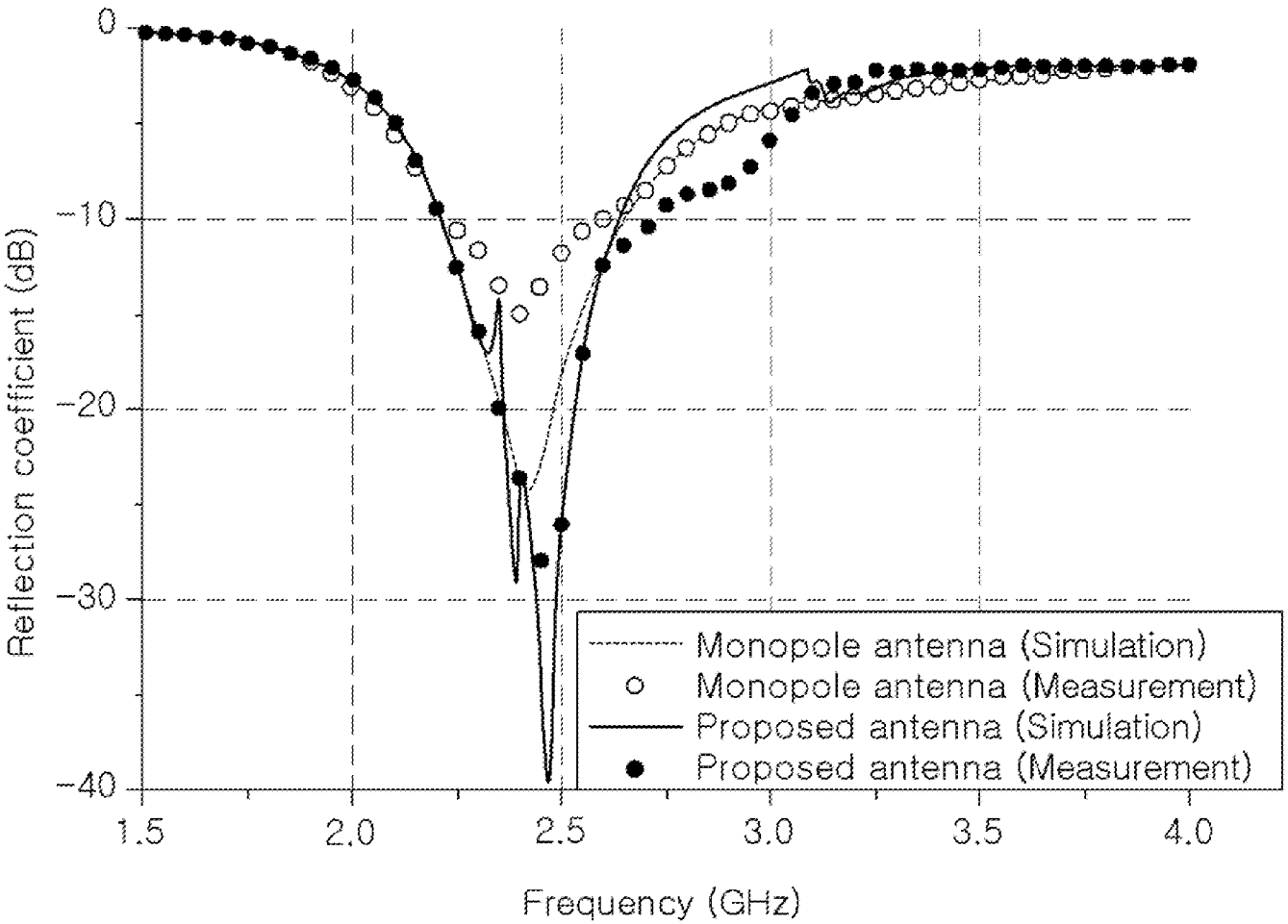

【FIG. 10】
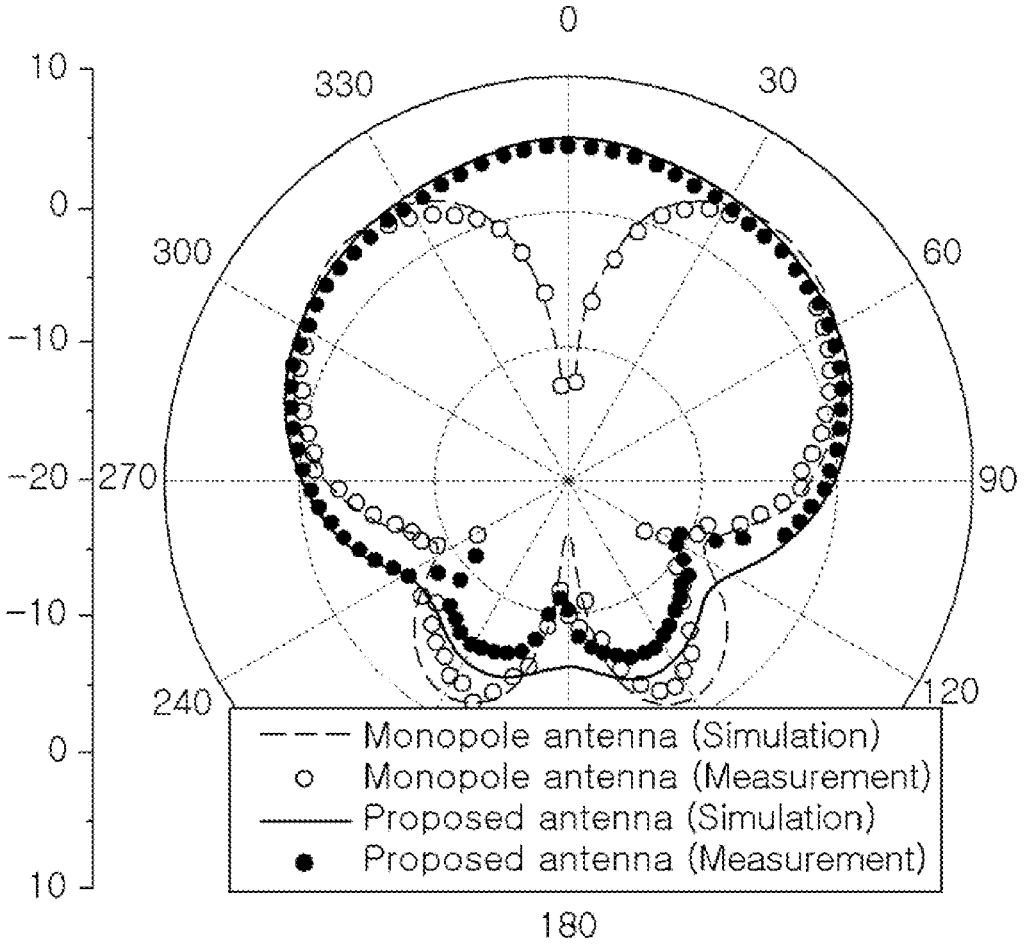

【FIG. 11】
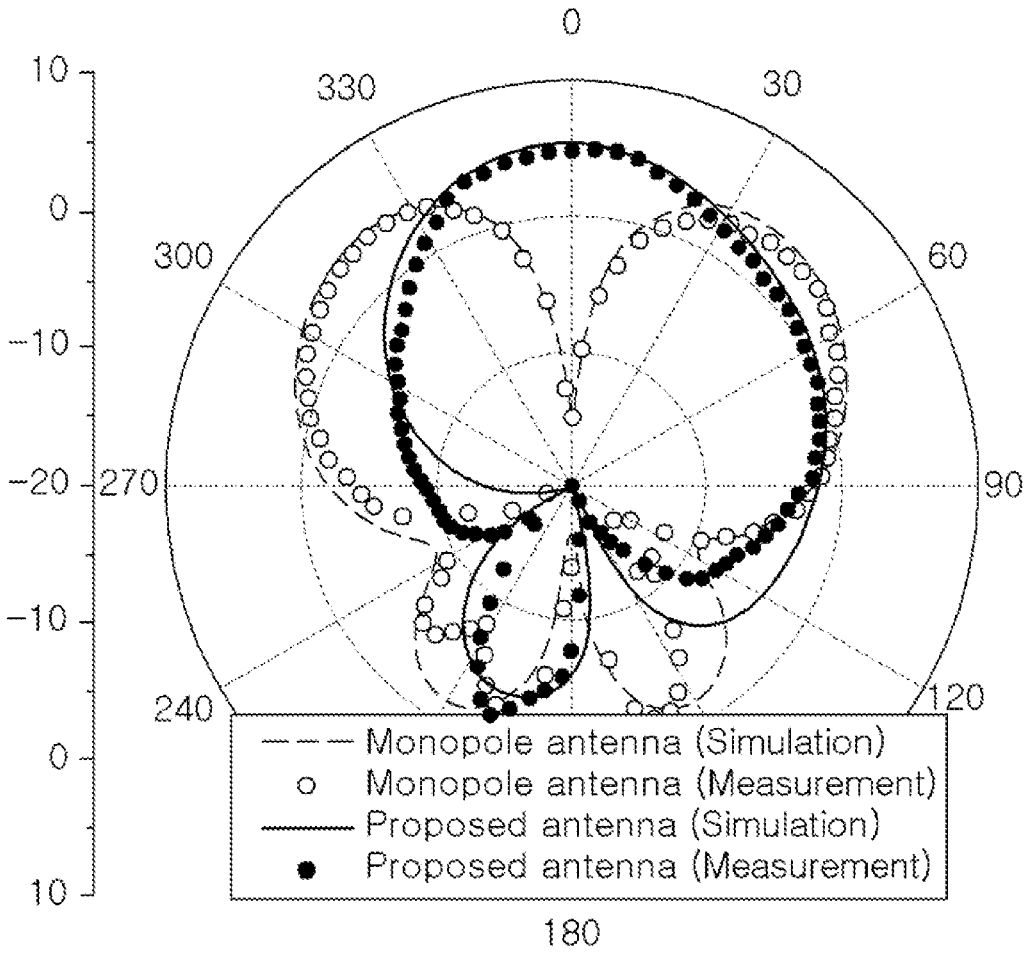

【FIG. 12】
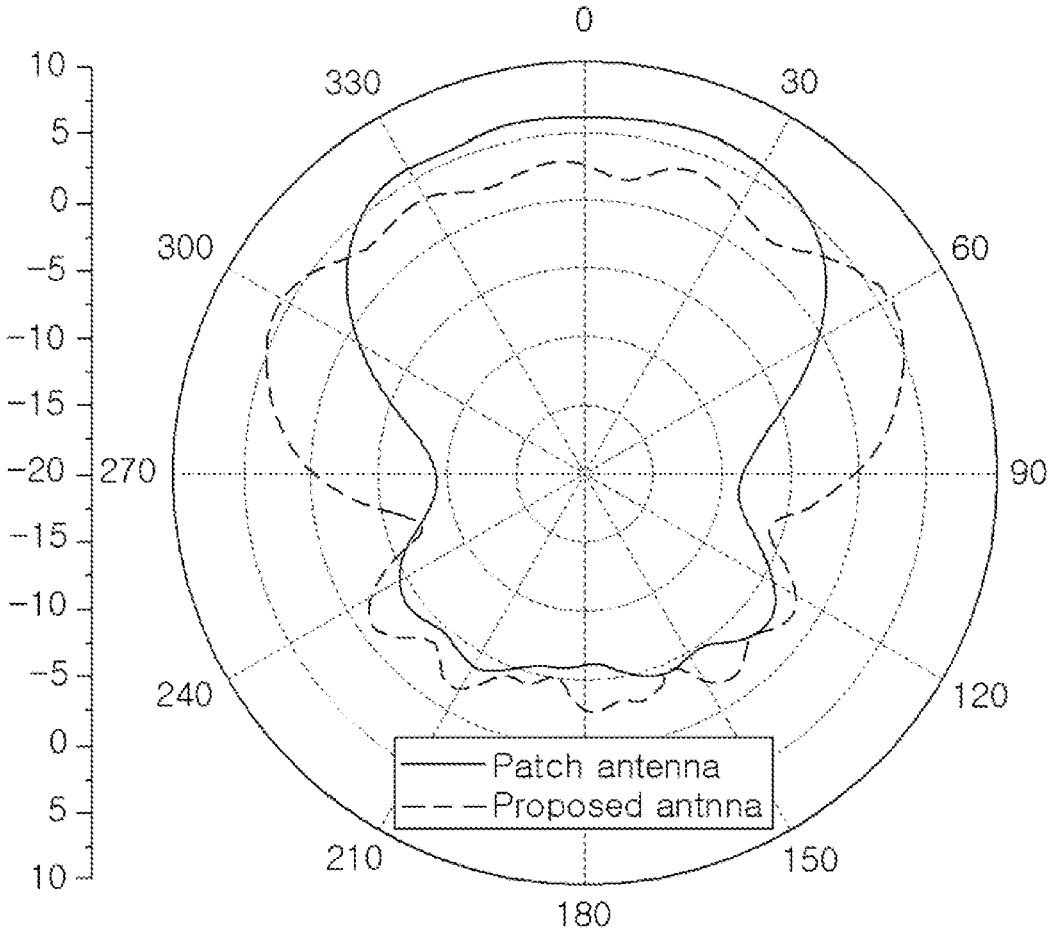

【FIG. 13】
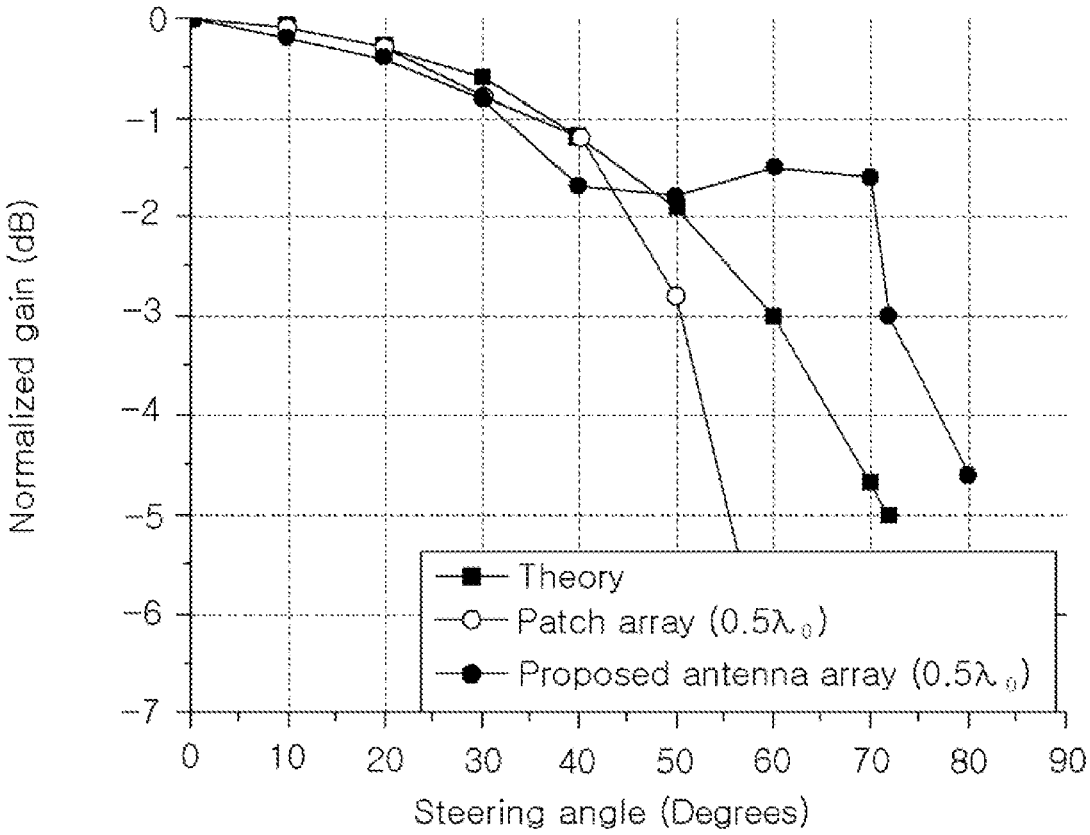

DIRECTIONAL MONOPOLE ARRAY ANTENNA USING HYBRID TYPE GROUND PLANE

CROSS-REFERENCE TO RELATED APPLICATION

This application claims priority to and the benefit of Korean Patent Application No. 10-2017-0087772 filed in the Korean Intellectual Property Office on Jul. 11, 2017, the entire contents of which are incorporated herein by reference.

BACKGROUND OF THE INVENTION

(a) Field of the Invention

The present invention relates to a directional monopole array antenna using a hybrid type ground plane, and more particularly, to a directional monopole array antenna using a hybrid type ground plane, which uses a ground plane designed with a PMC (perfect magnetic conductor) and a PEC (perfect electric conductor) to increase a beam width of an active element pattern, to maintain a reflection coefficient, and to have directionality.

(b) Description of the Related Art

A microstrip patch array antenna, which is one of planar antennas, is manufactured by using a printed board, and thus it is suitable for mass production, has a simple manufacturing process, has a low height, and is flat and robust. Therefore, although it is widely used as an array antenna device requiring a large number of small antennas, there is a disadvantage in that the gain is insufficient.

When the microstrip patch array antenna is designed by using an array structure to perform beam steering, a steering angle at a 3 dB bandwidth is limited to a maximum of 50°. Accordingly, various structures have been proposed to expand the steering angle. Therefore, a beam width of an active element pattern (AEP) is increased by reducing mutual coupling or using a meta-structured antenna, but a complexity of the design is increased.

A 5G mobile communication antenna and military radar require an array antenna capable of steering the beam width. However, a conventional array antenna has a disadvantage in that when the antenna is steered at 50° or more, the gain of the antenna is remarkably reduced, so that a high output is required and the power consumption is also increased The technique of the present invention is disclosed in Korean Patent Laid-Open Publication No. 10-2008-0038061 (published on May 2, 2008).

The above information disclosed in this Background section is only for enhancement of understanding of the background of the invention and therefore it may contain information that does not form the prior art that is already known in this country to a person of ordinary skill in the art.

SUMMARY OF THE INVENTION

The present invention has been made in an effort to provide a directional monopole array antenna using a hybrid type ground plane, which uses a ground plane designed with a PMC and a PEC to increase a beam width of an active element pattern, to maintain a reflection coefficient, and to have directionality.

An exemplary embodiment of the present invention provides a directional monopole array antenna using a hybrid type ground plane in which a plurality of monopole antennas are connected in a form of an array, wherein each of the monopole antennas includes: a ground plane designed to be divided into a PMC and a PEC such that a surface current induced in the PEC flows in a direction; and an antenna device vertically disposed in the ground plane.

In this case, the ground plane may be designed to have a size that is equal to or smaller than one wavelength of an antenna signal.

The PMC may be designed in a half area of the ground plane, and a dielectric pattern capable of phase adjustment may be inserted at predetermined intervals to serve as a reflector.

The PMC may be designed to have at least one of a corrugated soft surface structure, a mushroom structure, a hilbert curve structure, and a peano curve structure.

The monopoles may be formed to have a folded or spiral structure.

The PMC may serve to block a leakage current.

The monopole antennas may have a reflection coefficient of 20% or more at a bandwidth of −10 dB and a steering angle of more than 70° at a 3 dB bandwidth.

As such, according to the exemplary embodiment of the present invention, it is possible to design the directional monopole antenna using the hybrid type ground plane by dividing the ground plane of the monopole antenna having a simple structure into PMC and PEC areas such that the beam width of the active element pattern can be increased, the reflection coefficient can be maintained, and the direction of the surface current induced in the ground plane can be controlled, to thereby obtain the directionality.

In addition, according to the exemplary embodiment of the present invention, the gain of the antenna can be increased by designing a monopole antenna capable of steering the optical beam-width with a steering angle of 70° or more in the 3 dB bandwidth at an RF front end thereof.

BRIEF DESCRIPTION OF THE DRAWINGS

FIG. 7 illustrates a distribution of a surface current flowing in a ground plane when a size of the ground plane is equal to or greater than 2λ of an antenna signal according to an exemplary embodiment of the present invention.

FIG. 8 illustrates a distribution of a surface current flowing in a ground plane when a size of the ground plane is equal to or greater than 3λ of an antenna signal according to an exemplary embodiment of the present invention.

FIG. 9 is a graph illustrating comparisons between simulations of a monopole antenna depending on whether a hybrid type ground plane is applied and measured reflection coefficients according to an exemplary embodiment of the present invention.

FIG. 10 is a graph illustrating comparisons between simulations of a monopole antenna depending on whether a hybrid type ground plane is applied and measured long-distance radiation patterns (n-t plane) according to an exemplary embodiment of the present invention.

FIG. 11 is a graph illustrating comparisons between simulations of a monopole antenna depending on whether a hybrid type ground plane is applied and measured long-distance radiation patterns (n-l plane) according to an exemplary embodiment of the present invention.

FIG. 12 is a graph illustrating a comparison between active element patterns of a patch array antenna and a monopole array antenna according to an exemplary embodiment of the present invention.

FIG. 13 is a graph illustrating a normalized gain comparison between a patch array antenna and a monopole array antenna according to an exemplary embodiment of the present invention.

DETAILED DESCRIPTION OF THE EMBODIMENTS

Figure 1:
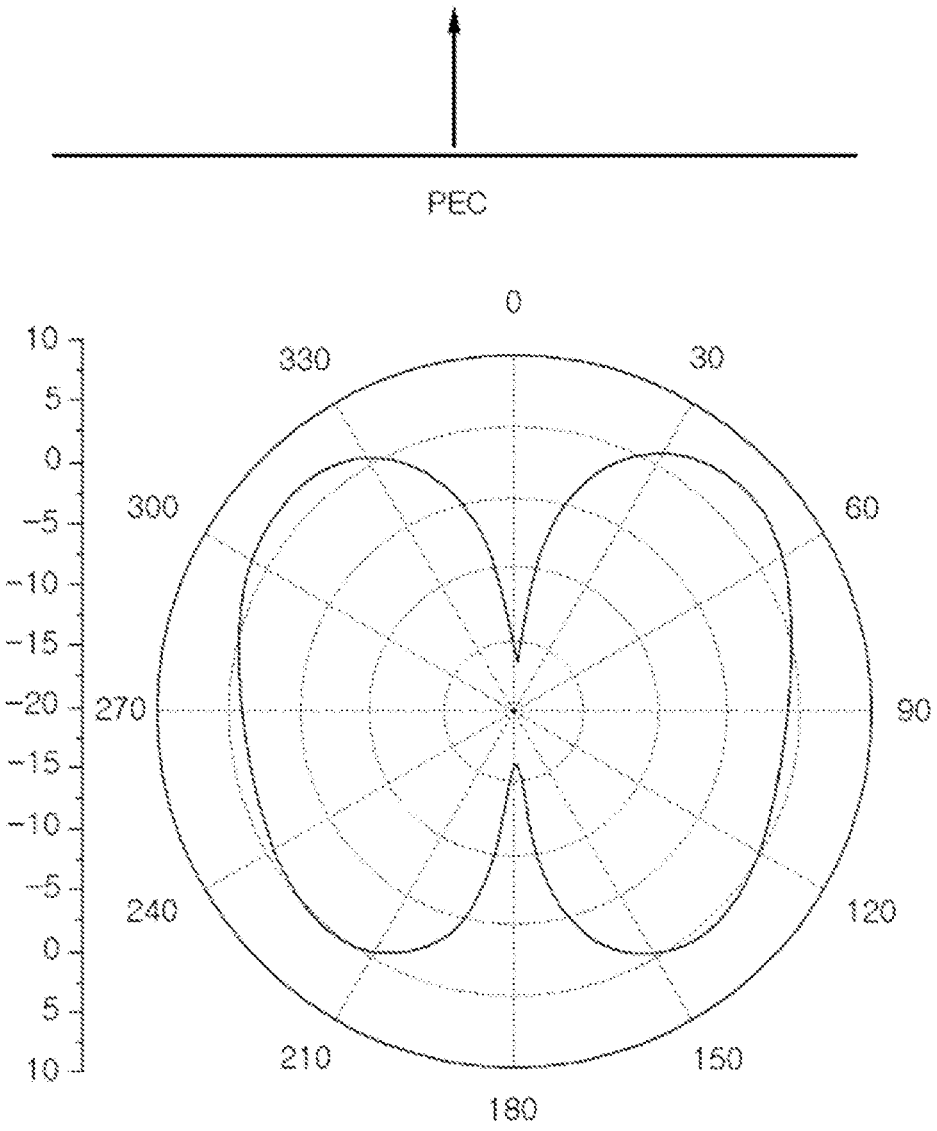
FIG. 1 illustrates a radiation pattern when an antenna is designed by using a PEC ground plane.

Exemplary embodiments of the present invention will be described in detail with reference to the accompanying drawings. The thicknesses of lines and the sizes of the components illustrated in the drawings may be exaggerated for the clarity and convenience of description.

Further, the terminologies described below are terminologies determined in consideration of the functions in the present invention and may be construed in different ways by the intention of users and operators or the custom. Therefore, the definitions of the terminologies should be construed on the basis of the contents throughout this specification.

Figure 2:
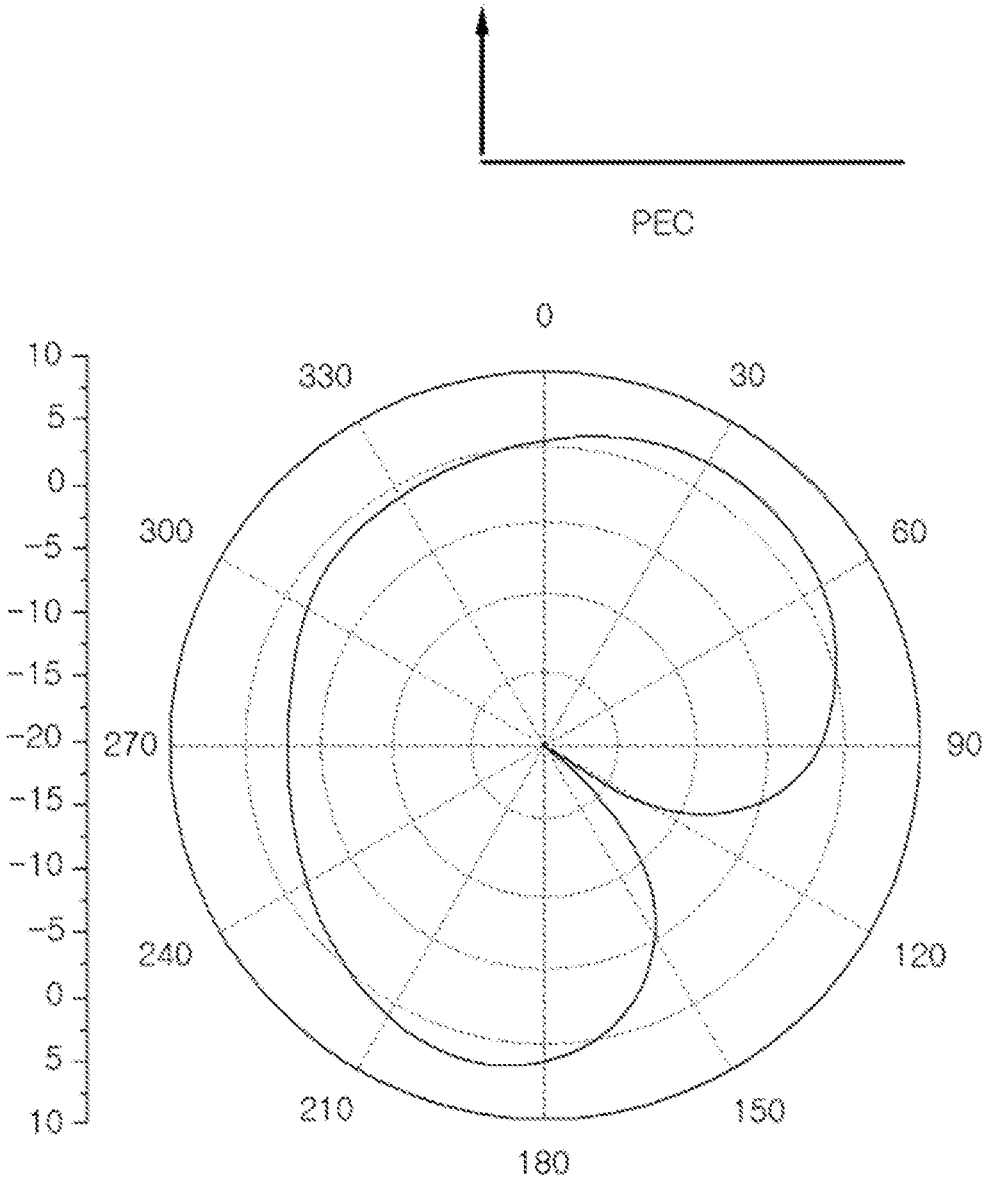
FIG. 2 illustrates the radiation pattern when a half of the ground plane of FIG. 1 is removed.
Figure 3:
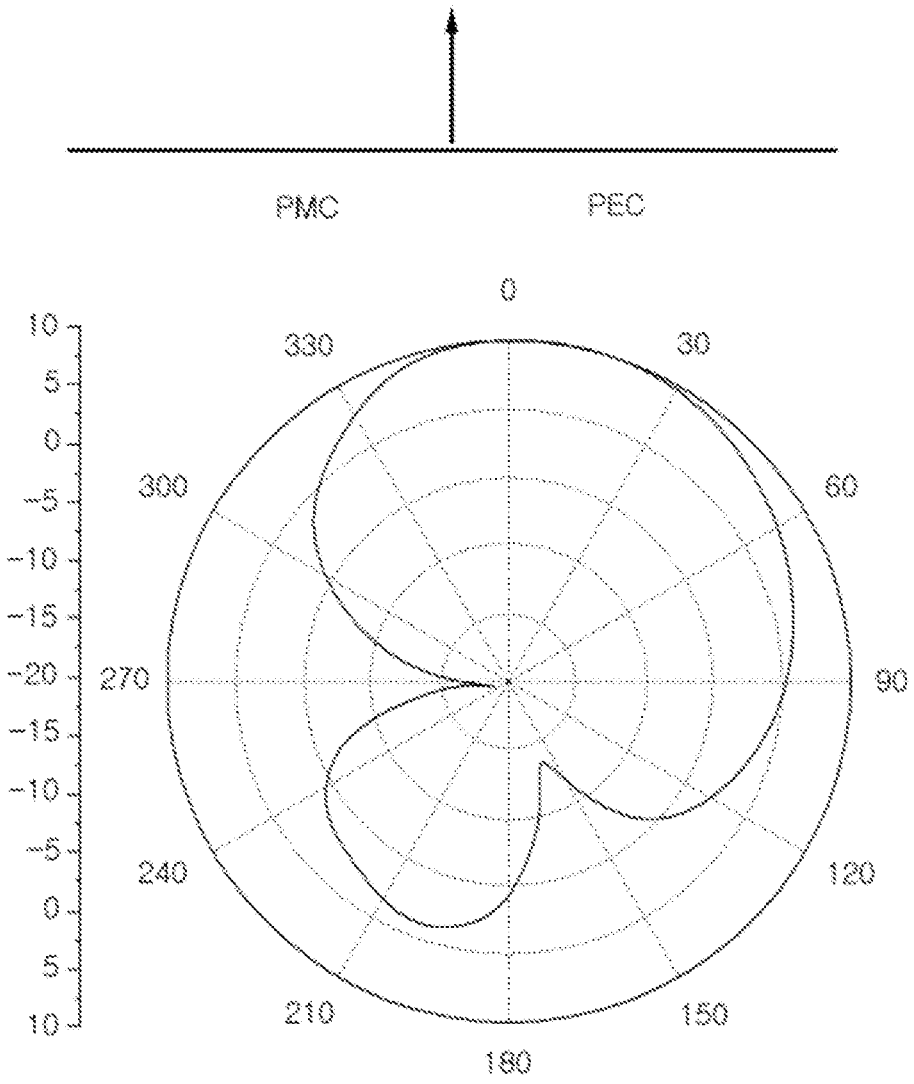
FIG. 3 illustrates a radiation pattern when an antenna is designed by using a hybrid type ground plane according to an exemplary embodiment of the present invention.

FIG. 1 illustrates a radiation pattern when an antenna is designed by using a PEC ground plane, FIG. 2 illustrates the radiation pattern when a half of the ground plane of FIG. 1 is removed, and FIG. 3 illustrates a radiation pattern when an antenna is designed by using a hybrid type ground plane according to an exemplary embodiment of the present invention.

First, as shown in FIG. 1, when being designed by using the PEC ground plane, the monopole antenna has a fixed reflection coefficient phase according to the characteristics of the PEC and has an omni-directional radiation pattern.

In addition, when the half of the ground plane of FIG. 1 is removed, an asymmetric horizontal current flows through the monopole antenna, and thus the omni-directional radiation pattern as shown in FIG. 1 may not be maintained.

Finally, as shown in FIG. 3, when the monopole antenna is designed by using the hybrid type ground plane according to the present exemplary embodiment, an asymmetric horizontal current flows in the ground plane as shown in FIG. 2. In this case, since the PMC acts as a reflector, a directional radiation pattern in a zenith direction is generated.

Figure 4:
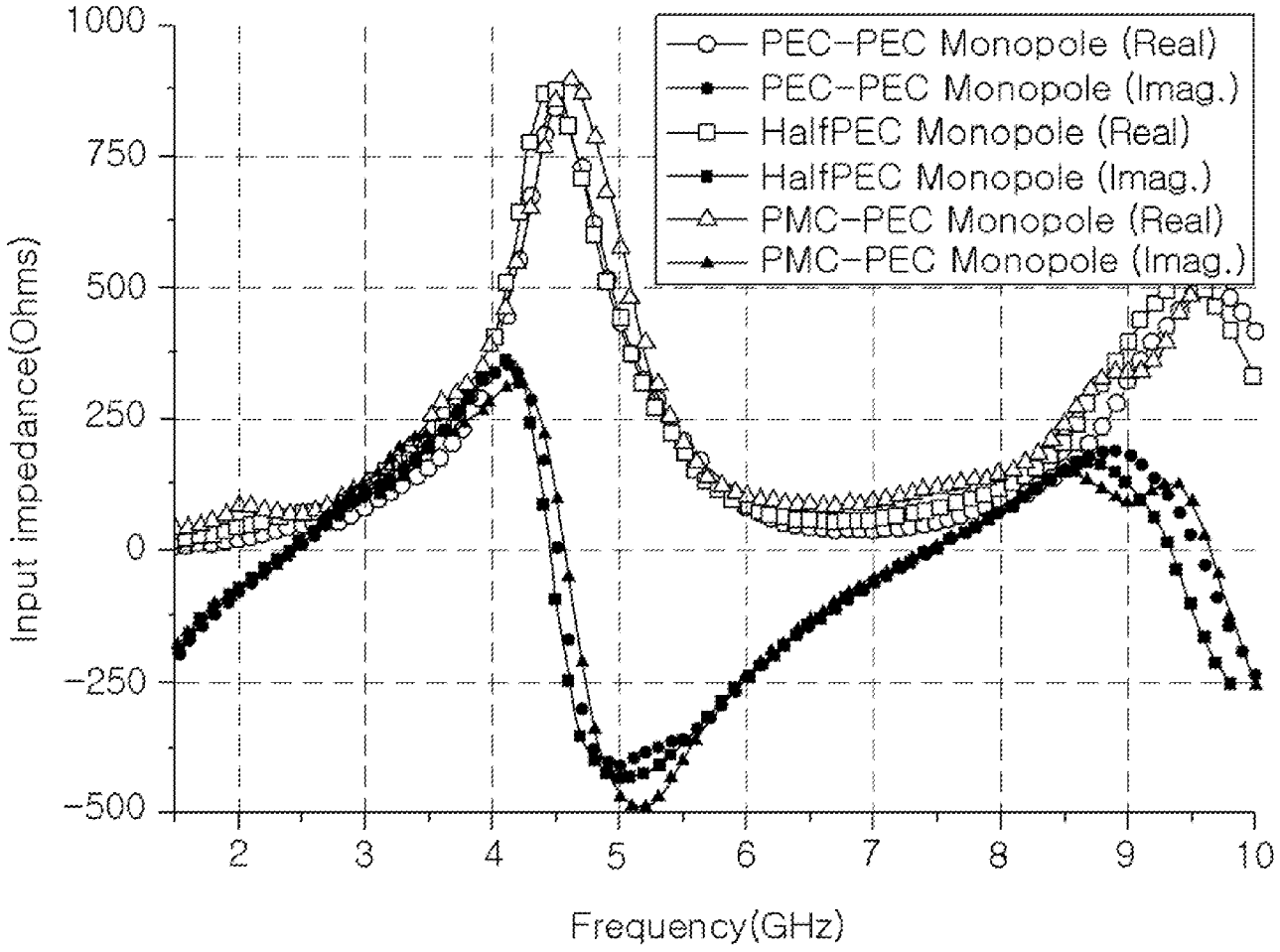
FIG. 4 is a graph illustrating simulation results of each input impedance of FIG. 1 to FIG. 3.

FIG. 4 is a graph illustrating simulation results of each input impedance of FIG. 1 to FIG. 3.

An input impedance of the monopole antenna is a ratio of a flowing current to an applied voltage, and thus an input impedance graph (PMC-PEC monopole) of the monopole antenna in which the ground is designed by using the PMC and the PEC is almost the same as FIG. 1 and FIG. 2. This is seen from FIG. 4.

Hereinafter, a directional monopole array antenna using a hybrid type ground plane according to an exemplary embodiment of the present invention will be described with reference to FIG. 5 to FIG. 8.

Figure 5:
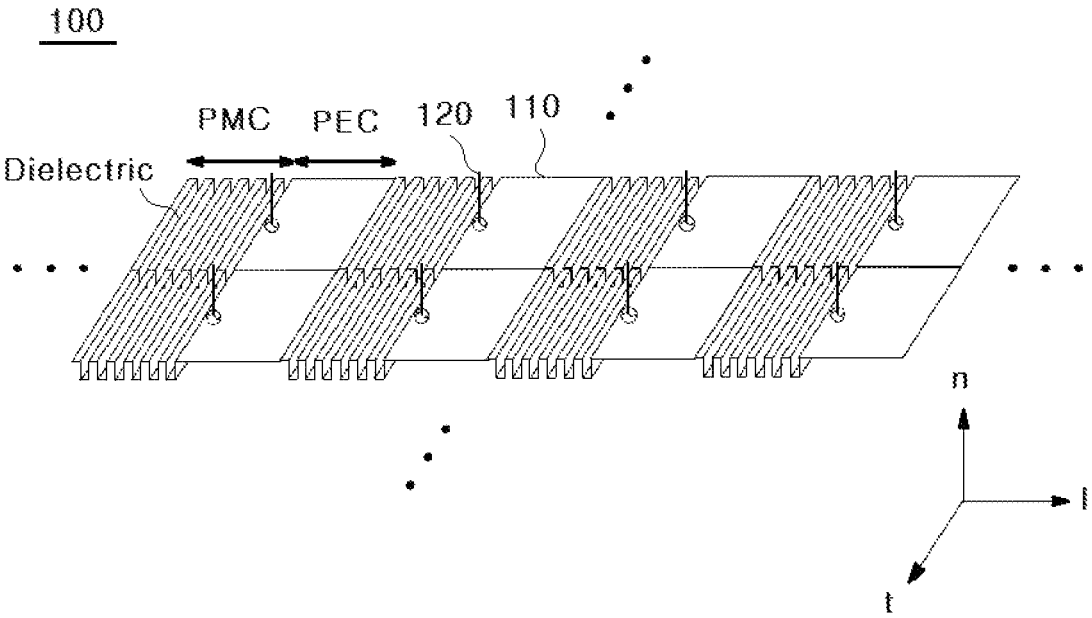
FIG. 5 illustrates a directional monopole antenna using a hybrid type ground plane according to an exemplary embodiment of the present invention.

FIG. 5 illustrates a directional monopole antenna using a hybrid type ground plane according to an exemplary embodiment of the present invention.

As shown in FIG. 5, the directional monopole antenna 100 using the hybrid type ground plane according to the present exemplary embodiment includes a ground plane 110 and an antenna device 120.

First, the ground plane 110 is separately designed by using the PMC and the PEC, and thus a surface current induced in the PEC flows in a direction as shown in FIG. 3.

Specifically, as shown in FIG. 5, the PMC is designed in a half area of the ground plane 110, and a dielectric pattern capable of phase adjustment is inserted at predetermined intervals to serve as a reflector to execute a function to shut off a leakage current.

Accordingly, when the dielectric material pattern is inserted into a corrugated soft surface structure as shown in FIG. 5, a depth of the dielectric material pattern has a ¼ wavelength, and thus the ground plane 110 operates as a high impedance surface, i.e., the PMC on a vertical-direction surface, and has a surface impedance of 0 on a horizontal-direction surface like the PEC.

The PMC may be designed to have at least one of a corrugated soft surface structure, a mushroom structure, a hilbert curve structure, and a peano curve structure. In addition, the PMC may be designed to have various structures.

The antenna device 120 is constituted by a conductor, and is vertically disposed in the ground plane 110 to perform functions of the monopole antenna 100.

According to the present exemplary embodiment, the monopole antenna 100 may be formed to have a folded or spiral structure.

Figure 6:
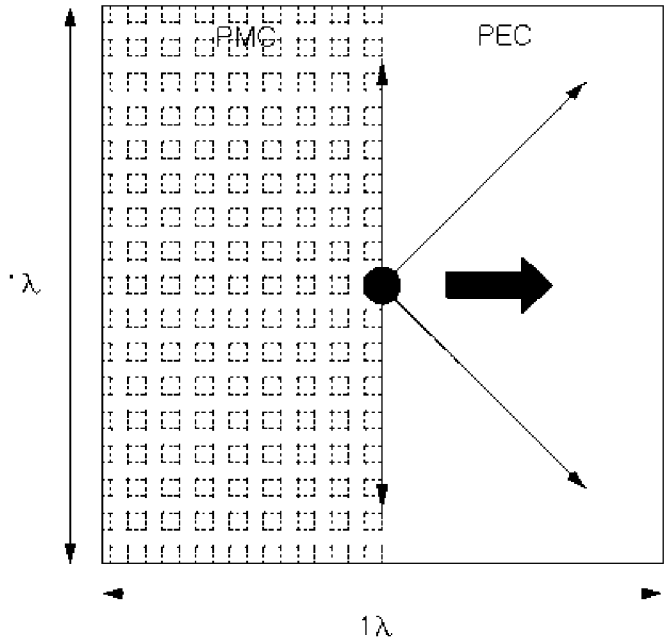
FIG. 6 illustrates a distribution of a surface current flowing in a ground plane when a size of the ground plane is equal to or greater than 1λ of an antenna signal according to an exemplary embodiment of the present invention.

FIG. 6 illustrates a distribution of a surface current flowing in a ground plane when a size of the ground plane is equal to or greater than 1λ of an antenna signal according to an exemplary embodiment of the present invention, FIG. 7 illustrates a distribution of a surface current flowing in a ground plane when a size of the ground plane is equal to or greater than 2λ of an antenna signal according to an exemplary embodiment of the present invention, and FIG. 8 illustrates a distribution of a surface current flowing in a ground plane when a size of the ground plane is equal to or greater than 3λ of an antenna signal according to an exemplary embodiment of the present invention.

When a size (area) of the entire ground plane 110 is smaller than the wavelength (1λ) of an antenna signal, a surface current as illustrated in FIG. 6 is generated. That is, the surface current in a same direction as an interface between the PMC and the PEC is canceled out, and the horizontal current in the vertical direction remains. Therefore, the directional radiation pattern in the zenith direction may be obtained by using the PMC and PEC ground plane 110 having a size smaller than the wavelength.

As illustrated in FIG. 7 and FIG. 8, when the size of the ground plane 110 increases by an integer multiple of the wavelength, a number of main lobes generated is also an integer multiple. Accordingly, when the size of the ground plane 110 is equal to or smaller than 2λ of the antenna signal, a direction of the current is the same as that in FIG. 7, so that the directional radiation pattern in the zenith direction may not be obtained. When the size of the ground plane 110 is equal to or smaller than 3λ of the antenna signal, the direction of the current is the same as that in FIG. 8, so that the omni-directional radiation pattern may be obtained, thereby deteriorating the directionality of the antenna. Accordingly, the ground plane 110 may be designed to have a size that is equal to or smaller than one wavelength of the antenna signal.

Hereinafter, a performance of the directional monopole array antenna using the hybrid type ground plane according to an exemplary embodiment of the present invention will be described with reference to FIG. 9 to FIG. 13.

FIG. 9 is a graph illustrating comparisons between simulations of a monopole antenna depending on whether a hybrid type ground plane is applied and measured reflection coefficients according to an exemplary embodiment of the present invention.

As described above, since the input impedances of the monopole antenna to which the hybrid type ground plane 110 is not applied and the monopole antenna to which the hybrid type ground plane 110 is applied are almost the same, it is seen that reflection coefficients are measured to be the same.

As a result, the monopole antenna 100 according to the exemplary embodiment of the present invention has a broad band compared to a patch array antenna having a conventional directional radiation pattern since it has a reflection coefficient of 20% or more at a bandwidth of −10 dB and a steering angle of more than 70° at a 3 dB bandwidth.

FIG. 10 is a graph illustrating comparisons between simulations of a monopole antenna depending on whether a hybrid type ground plane is applied and measured long-distance radiation patterns (n-t plane) according to an exemplary embodiment of the present invention, and FIG. 11 is a graph illustrating comparisons between simulations of a monopole antenna depending on whether a hybrid type ground plane is applied and measured long-distance radiation patterns (n-l plane) according to an exemplary embodiment of the present invention.

As illustrated in FIG. 10 and FIG. 11, the directional monopole array antenna 100 using the hybrid type ground plane according to the exemplary embodiment of the present invention is able to obtain a peak gain of 4.5 dB and a beam width of 3 dB of 150°.

In addition, the beam width of the active element pattern can be expanded by connecting a plurality of monopole antennas 100 in a form of an array in consideration of mutual coupling between the antennas so as to enable light beam steering.

FIG. 12 is a graph illustrating a comparison between active element patterns of a patch array antenna and a monopole array antenna according to an exemplary embodiment of the present invention.

Specifically, FIG. 12 shows that the active device pattern of the fourth monopole antenna 100 is calculated through a simulation by connecting the eight monopole antennas 100 in the array form at 5 GHz, and it is seen that the normalized gain is gently reduced by 3 dB.

FIG. 13 is a graph illustrating a normalized gain comparison between a patch array antenna and a monopole array antenna according to an exemplary embodiment of the present invention.

As illustrated in FIG. 13, the patch array antenna (Patch array) can be beam-steered at 50° at a 3 dB bandwidth, while the monopole array antenna (Proposed antenna array) according to the exemplary embodiment of the present invention can be beam-steered at 70° or more by having a wide active element pattern.

As described above, according to the exemplary embodiment of the present invention, it is possible to design the directional monopole antenna using the hybrid type ground plane by dividing the ground plane of the monopole antenna having a simple structure into PMC and PEC areas such that the beam width of the active element pattern can be increased, the reflection coefficient can be maintained, and the direction of the surface current induced in the ground plane can be controlled, to thereby obtain the directionality.

In addition, according to the exemplary embodiment of the present invention, the gain of the antenna can be increased by designing a monopole antenna capable of steering the optical beam-width with a steering angle of 70° or more in the 3 dB bandwidth at an RF front end thereof.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

| <Description of Symbols> | |
|---|---|
| 100: monopole antenna | 110: ground plane |
| 120: antenna device | |

What is claimed is:

1. A directional monopole array antenna, comprising:

a plurality of monopole antennas connected in a form of an array, each of the plurality of monopole antennas comprising:

a ground plane formed with a PMC (perfect magnetic conductor) surface and a PEC (perfect electric conductor) surface, wherein a half area of the ground plane is the PMC surface and the other half area of the ground plane is the PEC surface, such that a surface current inducted in the PEC surface flows in a direction; and an antenna device vertically disposed in the ground plane between the PMC surface and the PEC surface.

2. The directional monopole array antenna of claim 1, wherein the ground plane has a size that is equal to or smaller than one wavelength of an antenna signal.

3. The directional monopole array antenna of claim 1, wherein a dielectric pattern is formed on the PMC surface at predetermined intervals to serve as a reflector.

4. The directional monopole array antenna of claim 3, wherein the PMC surface has a corrugated soft surface structure.

5. The directional monopole array antenna of claim 1, wherein the PMC surface serves to block a leakage current.

6. The directional monopole array antenna of claim 1, wherein the monopole antennas have a reflection coefficient of 20% or more at −10 dB and a steering angle of more than 70° at 3 dB.

* * * * *